US007703186B1

(12) United States Patent
Williamson

(10) Patent No.: US 7,703,186 B1
(45) Date of Patent: Apr. 27, 2010

(54) CASKET AND BURIAL SYSTEM

(76) Inventor: Gerald F. Williamson, 1308 Ivinson Ave., Laramie, WY (US) 82070

( * ) Notice: Subject to any disclaimer, the term of this patent is extended or adjusted under 35 U.S.C. 154(b) by 348 days.

(21) Appl. No.: 11/824,199

(22) Filed: Jun. 30, 2007

Related U.S. Application Data

(60) Provisional application No. 60/818,163, filed on Jun. 30, 2006.

(51) Int. Cl.
*A61G 17/00* (2006.01)

(52) U.S. Cl. ..... 27/2; 27/17; 27/35; 52/142

(58) Field of Classification Search ..... 27/2, 27/35, 15, 17; 52/129, 136, 137, 139, 142; 220/4.25

See application file for complete search history.

(56) References Cited

U.S. PATENT DOCUMENTS 3,188,712 A * 6/1965 Bauermeister ..... 27/6
3,348,280 A 10/1967 Myers
3,581,452 A 6/1971 Jalbert
3,681,820 A * 8/1972 Jalbert ..... 27/7
3,898,718 A 8/1975 Eubank
3,918,133 A * 11/1975 Schmitz ..... 27/2
3,940,894 A * 3/1976 Nunes ..... 52/129
4,328,606 A 5/1982 Nunes
5,606,785 A 3/1997 Shelberg et al.
5,659,932 A * 8/1997 Wright ..... 27/7
2002/0144383 A1* 10/2002 Spence ..... 27/35
2007/0050958 A1* 3/2007 Scruggs ..... 27/2

FOREIGN PATENT DOCUMENTS

WO WO 2004100849 A2 * 11/2004

* cited by examiner

*Primary Examiner*—William L. Miller
(74) *Attorney, Agent, or Firm*—Roland H. Shubert

(57) ABSTRACT

A casket and burial system for human remains includes a casket fabricated from plastics and polymer composites, such as glass-fiber reinforced plastic. The casket includes a base member, a cover member fitting atop the base, and top and bottom closure panels having one or more ports for use in replacing the ambient atmosphere within the sealed casket with a selected gas or fluid such as nitrogen, or to inject a plastic foam into the free space remaining in the casket. The casket is preferably interred in a vertical attitude as that arrangement allows up to four caskets to fit within a standard grave plot.

18 Claims, 8 Drawing Sheets

CASKET AND BURIAL SYSTEM

REFERENCE TO RELATED APPLICATION

This application claims benefit of U.S. Provisional Application No. 60/818,163, filed Jun. 30, 2006.

BACKGROUND OF THE INVENTION

1. Field of the Invention

This invention relates to a casket that is particularly adapted for the upright, or vertical, burial of human remains and to a burial system therefor.

In particular, this invention relates to a casket that is constructed of plastics, polymers, recycled plastics and polymer composites such as glass-fiber reinforced plastic, and the use where appropriate of specialized polymers and reinforcements, and to modes for its use in the burial of human remains. The casket may also be fabricated from materials that are totally biogradable when allowed to remain in the ground for a period of time while displaying the same physical features and structural integrity prior to its being committed to the ground as does a conventional casket.

2. Description of Related Art

Land available for use as cemeteries or burial grounds is becoming increasingly scarce in many urbanized areas of the world. Consequently, that shortage has led to various proposals for more efficient use of available space. Among those proposals are a number that are directed to the upright, or vertical, burial of human remains including, for example, U.S. Pat. No. 3,348,280. That patent discloses a closed tubular burial vault that is installed vertically into the ground so that its upper end is flush with the ground surface. A generally cylindrical casket containing human remains and sized to fit the vault is then lowered into the vault and is sealed therein by means of a lid member that is secured to the upper vault end. Both casket and vault may be constructed of a variety of plastic materials and composites.

Other examples include U.S. Pat. No. 4,328,606 which discloses a burial system having a plurality of vertically disposed and interconnected tubular concrete vaults. An end-opening tubular casket is disposed in each vault, and the vault is then closed by means of fitted covers. A patent to Jalbert, U.S. Pat. No. 3,581,452, describes a burial vault that has a plurality of vertically disposed chambers, each adapted to receive a casket. The vault is sized to fit a normal grave site plot. In another variation, Eubank in U.S. Pat. No. 3,898,718 describes a burial system in which vertical, cased bores are arranged to accommodate as many as three caskets in an end-to-end stacked arrangement, one atop another.

SUMMARY OF THE INVENTION

A casket and burial system is provided in which the casket includes a casket base, a casket cover, and top and bottom end closure panels. The casket base and cover are preferably fabricated from appropriate polymers, and also from plastic that is appropriately reinforced with glass fibers as may be the top end closure panels. The lower end closure panels may also be fabricated from reinforced plastic or, optionally from a combination of suitable biodegradable structural solid components. Provision is made for injecting a foam material, either open cell or closed cell, into the casket through one or more ports provided in the closure panels to immobilize the interred body when the casket is oriented vertically for burial. From a functional land-use viewpoint, a vertical burial allows placement of up to four caskets in a burial plot that ordinarily seeks to accommodate a single horizontally placed casket. In many jurisdictions and locales, the need to place a burial casket inside a sealed vault could be negated and thereby further significantly reduce the cost of a funeral—without any untoward effect on concerns that relate to the contamination of the surrounding soils. A casket of this invention that is fabricated from non-biodegradable materials will not cause local subsidence, and subsidence is a primary reason that many cemeteries require a vault. Inundations and subsidence tend to be caused by the degradation of the casket itself, as well as the degradation of the casket contents and, in the use of biodegradable caskets, the area susceptible to subsidence will be localized and far less intrusive that would be the collapse of a full-sized horizontal grave.

DESCRIPTION OF PREFERRED EMBODIMENTS OF THE INVENTION

Figure 1:
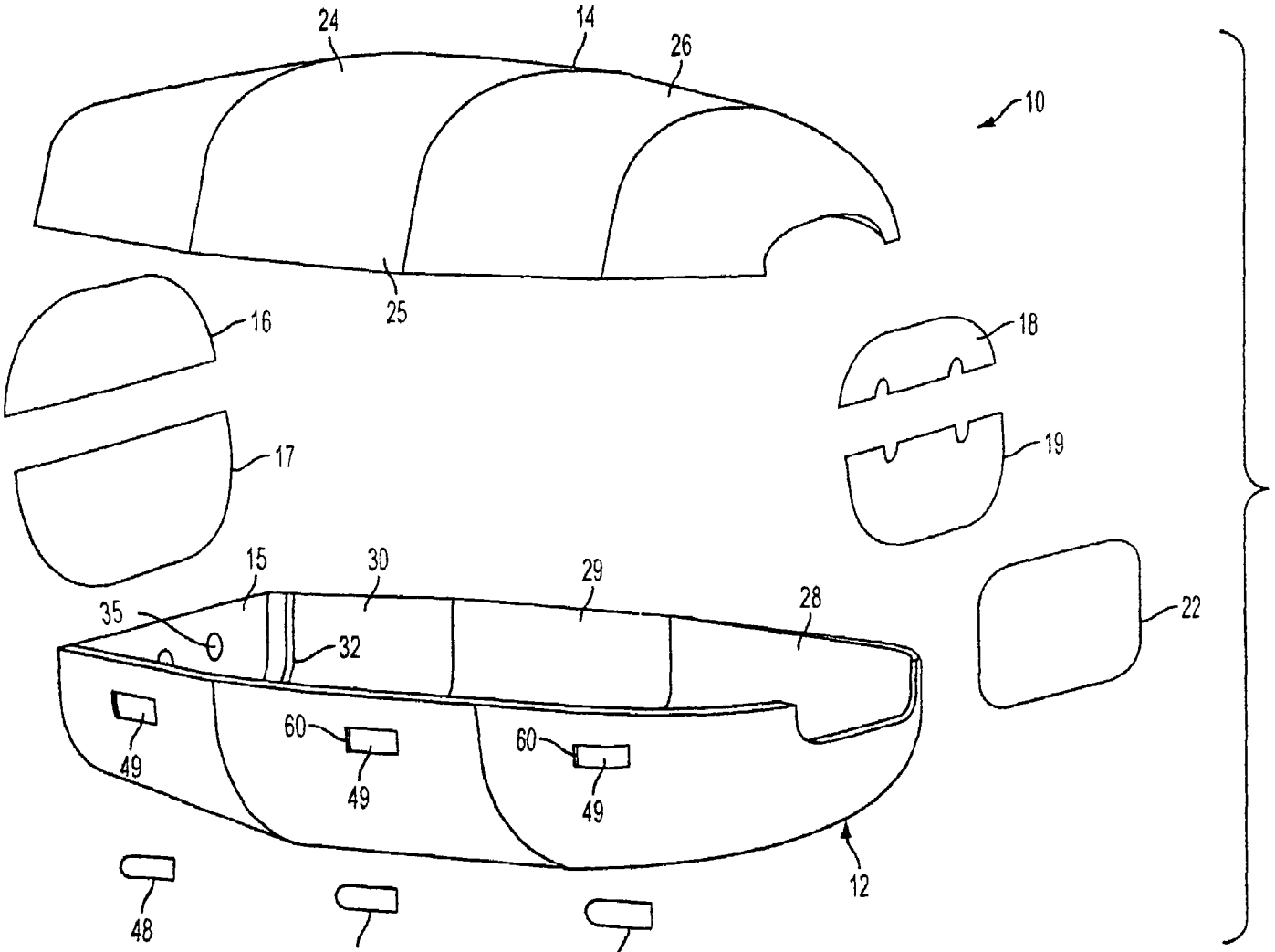
FIG. 1 is an exploded perspective view of the casket system of this invention showing the positioning and relationship of the parts.

Certain preferred embodiments of this invention will be described through reference to the drawings in which FIG. 1 depicts at 10 an exploded view of the casket and burial system of the invention. Casket assembly 10 includes a casket base 12 and a casket cover 14. The casket is closed at the foot or bottom end by means of closure panels 16 and 17, panel 16 fitting into a channel 34 (FIGS. 4 and 5) provided at the bottom end of the casket cover, and panel 17 fitting into a channel 32 provided at the foot or bottom end of the casket base. Similarly, the top end of the casket is closed by a pair of closure panels 18 and 19, panel 18 fitting into a channel or guide slot 36 (FIGS. 4 and 5) that is provided at the top end of the casket cover, and panel 19 fitting into a channel or guide slot 38 (FIGS. 3 and 4) that is provided at the top end of the casket base. A headstone, or identification marker, 22 may be fitted to the casket end on the exterior side of closure panels 18 and 19 to identify the grave site.

Figure 2:
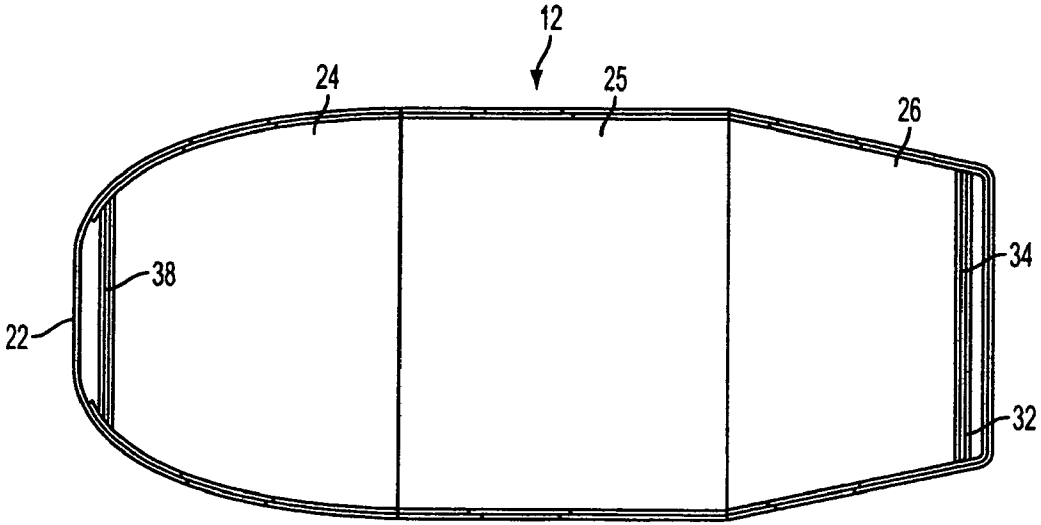
FIG. 2 is a top plan view of the casket base.
Figure 3:
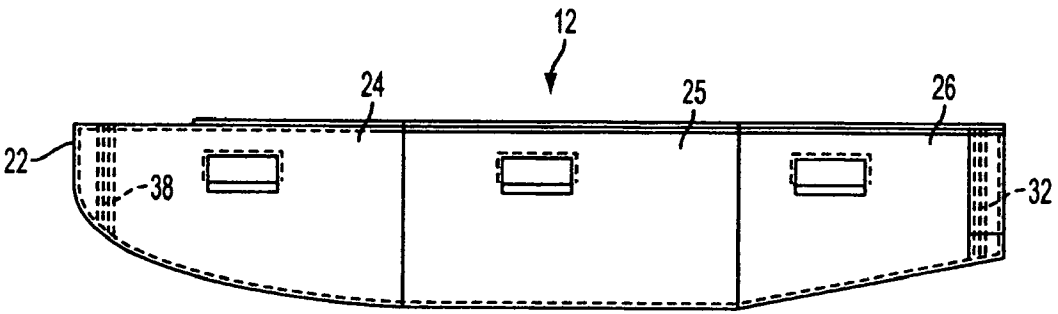
FIG. 3 is a side elevational view of the casket base.

Referring specifically now to FIGS. 2 and 3 in addition to FIG. 1, the casket base 12 is shown in plan view in FIG. 2 and is shown in side elevational view in FIG. 3. In a preferred embodiment, casket base 12 includes an upper section 24, a central section 25 and a lower section 26. The central section 25 may be of regular shape, suitably hemispherical, while both the upper section 24 and the lower section 26 may taper or curve inwardly as is illustrated.

Figure 5:
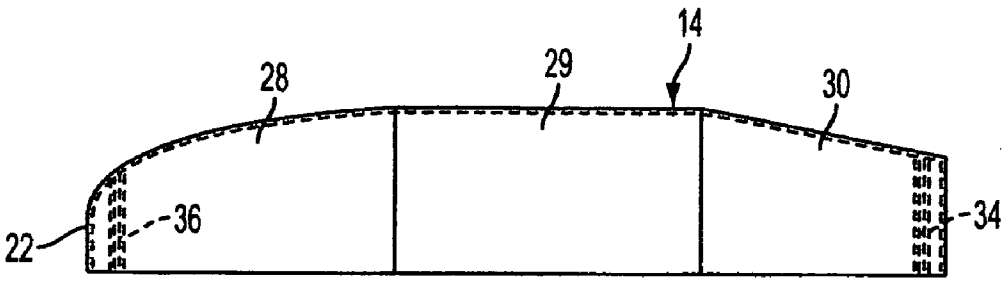
FIG. 5 is a side elevational view of the casket cover.
Figure 4:
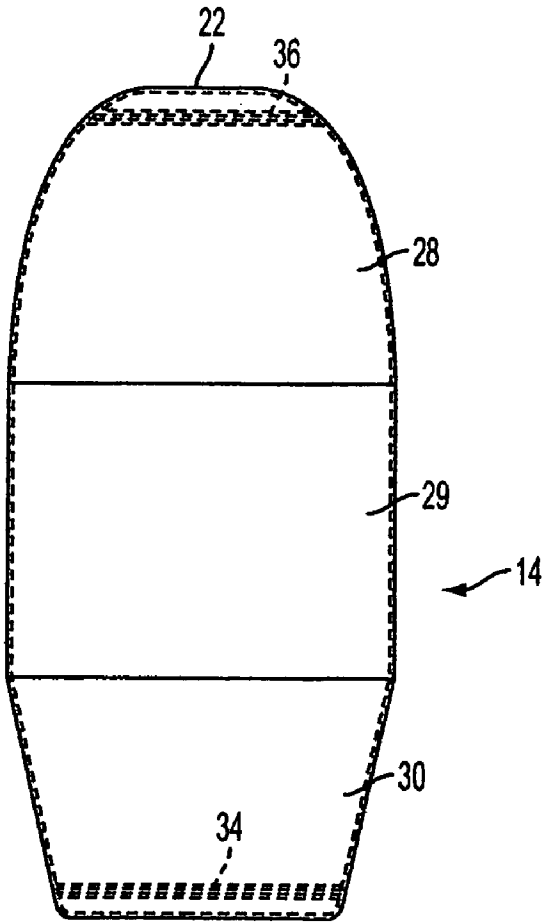
FIG. 4 is a top plan view of the casket cover.

The casket cover 14 shown in FIG. 1 is illustrated in more detail in FIGS. 4 and 5. Cover 14 includes an upper section 28 that conforms in cross sectional shape to base upper section 24, a central section 29 that conforms in cross sectional shape to the base central section 25, and a lower section 30 that conforms in cross sectional shape to the base lower section 26 so that the base 12 and cover 14 fit together to form a generally cylindrical structure that is open at the top and bottom ends. As is shown in the FIG. 1 exploded view, the bottom end of the casket base is closed by one or more panels 15, 17 that fit within one or more corresponding channels 32 which are provided at the interior end of the casket base. Similarly, the top end of the casket base is closed by one or more panels 19 that fit within one or more corresponding channels 38 which are provided at the head end of the casket base.

Figure 8:
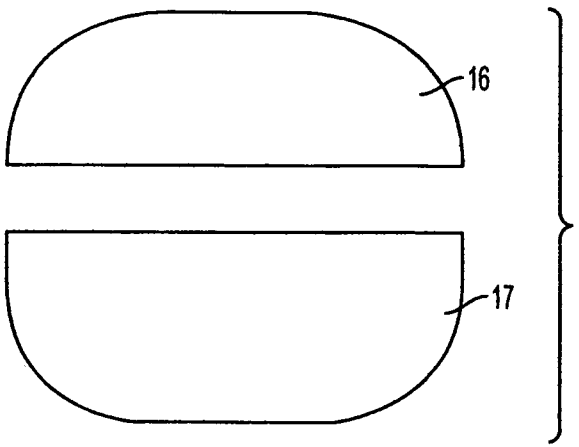
FIG. 8 is a plan view of a two-piece closure panel for the casket ends.
Figure 6:
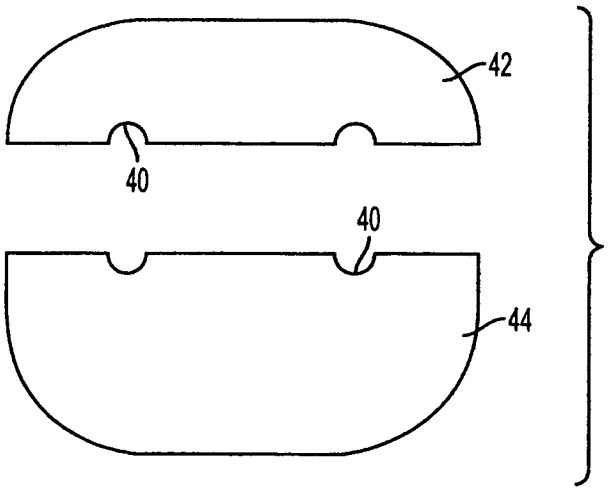
FIG. 6 is a plan view of a two-piece injection panel that forms a closure for the casket ends.

As is illustrated in FIGS. 6 and 8, as well as in FIG. 1, the closure panels are generally planar and may be either solid as are panels 16 and 17 or may be provided with one or more ports 35 as with panel 15. Ports 35 may be wholly bounded by the panel member as are those of panel 15 or may be formed by matching hemispherical cut-outs 40 in the casket cover panel 42 and its mating casket base panel 44.

Figure 7:
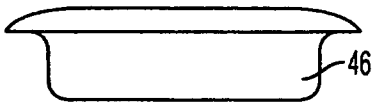
FIG. 7 is a side elevational view of a plug member arranged to seal the injection panel after foam injection.

The ports may serve a number of different functions. In some instances, for example, it is desired that decay of the interred body be retarded to the greatest extent possible and, in that instance, ports 35 may be used to replace the ambient atmosphere within the casket with an inert gas such as nitrogen or argon or other decay inhibiting gas or mixture of gases. In another function, ports 35 serve as an injection point for a plastic foam. Any of the commonly used packaging, open or closed cell foams including, for example, expanded polyurethane, polystyrene and polyolefin foams may be used for this purpose. The injected foam sets to a rigid state to create support means for the interred body when the casket is placed in a vertical position. After port use is complete, each port is sealed by insertion of a plug member therein. A plug member 46 suitable for this purpose is illustrated in FIG. 7.

Figure 9:
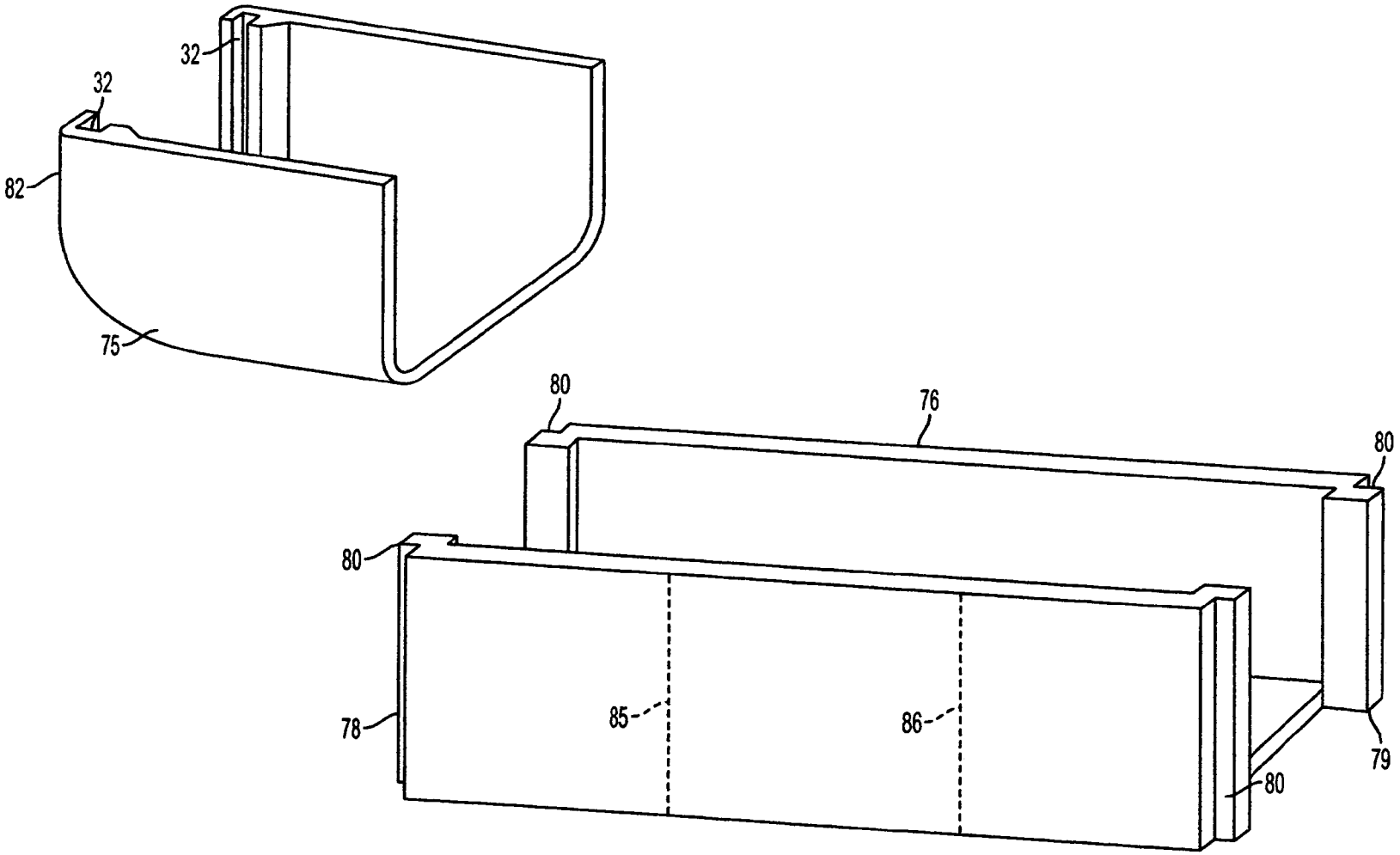
FIG. 9 illustrates an alternative embodiment of the casket base and cover.

The casket of this invention has been described as having a base and a cover that are sized and fabricated to fit together to form a generally cylindrical unit. Fabrication of the casket base and cover requires a mold for each. In the event that more than one size of casket is needed, then a separate mold set is required for each casket size. FIG. 9 illustrates a structural arrangement that is preferred in those instances wherein a range of casket lengths and sizes is desired. In this embodiment, both the casket base and casket cover includes three component parts; a lower foot section, a center section, and an upper head section. FIG. 9 shows the foot section 75 and the center section 76 of a casket base in which the center section ends 78 and 79 match the profile of the foot section 75 and of the head section (not shown.) The terminal end 82 of foot section 75 is identical in form and function to the foot end of the unitary casket base shown in FIGS. 1-3, having a channel or guide slot 32 for placement of a closure panel 17. Likewise, the terminal end of the head section (not shown) is identical in form and function to the head end of the unitary casket base shown in FIGS. 1-3.

Center section 76 is arranged to be fabricated in several different lengths; for example, from end 78 to first termination point 85, or to second termination point 86, or to the section end 79. No matter the length of center section 76, both the head and the foot section will remain unchanged, matching the profile of the center section ends. A head, center, and foot section must be joined in order to obtain a complete casket base or cover. Center section ends 78 and 79 incorporate an offset flange 80 that is arranged to fit over and overlap with the inside surface of the head and foot sections. Jointure of the sections, one to another, is preferably accomplished by applying a bonding agent, or adhesive, to the surface of the offset flange 80 so that a bond is formed between the flange surface and the interior surface of the foot and head sections. Mechanical fasteners, such as screws and the like, may be used instead of or in addition to adhesives and bonding agents.

Sectional construction of the casket base and cover also allows for convenient fabrication of caskets designed to accommodate unusually large cadavers. Most humans that are very large in dimension concentrate the maximum size and girth through the central part of the body while the head and foot areas are much more closely normal size. Those special needs may then be accommodated by providing an outwardly bowed shape to the central section, leaving the foot and head sections unchanged in size and shape. Also, sectional construction of the casket cover allows a part or all, but typically the head section, of the casket cover to be fabricated of a transparent, or at least semi-transparent, structural polymer such as polycarbonates.

In one preferred embodiment that is illustrated generally in FIG. 1, a plurality of detachable handles 48 are provided for removable attachment to the casket base at receptacles 49 at spaced locations thereon. Handle 48 is shown in perspective view in FIG. 10. It includes a lifting rail 51 held between a pair of bracket members 53, 54 extending outwardly from a base member 56. Ears 58 extend from the ends of base 56 to slide into and be retained by channels 60 that are provided at the sides of receptacles 49. The handles may be fitted in place on the casket base for convenient lifting and carrying of the casket by attendants or pall bearers.

Figure 11:
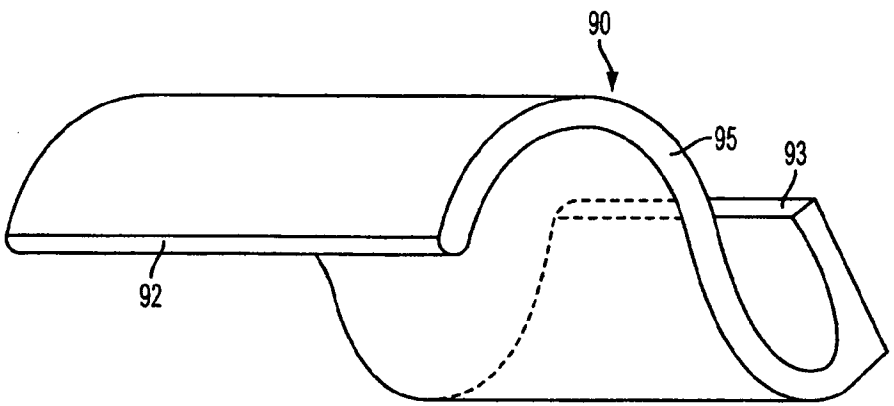
FIG. 11 depicts an alternative embodiment of the handle that is illustrated in FIG. 10.

An alternative, and in some cases preferred, handle embodiment 90 that may be used with casket bases of either unitary or sectional construction is illustrated in FIG. 11. In this embodiment, handle 90 is preferably of one-piece construction having an outwardly extending, lifting portion 92 and an upwardly directed, casket-engaging wedge attachment portion 93. The lifting or gripping part of the handle 92 is connected to the attachment area 93 through a continuous structural web 95. Handle 90 may be constructed of any material, such as structural plastics and cast metals that is capable of withstanding the loads placed upon it.

Figure 14:
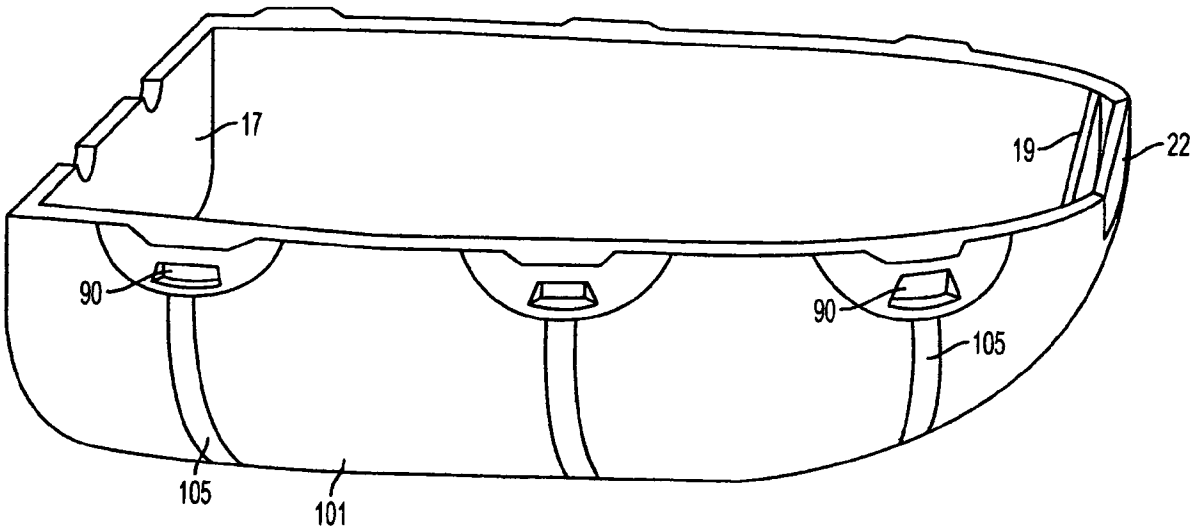
FIG. 14 shows a plurality of handle pairs as employed with the casket system of this invention.
Figure 12:
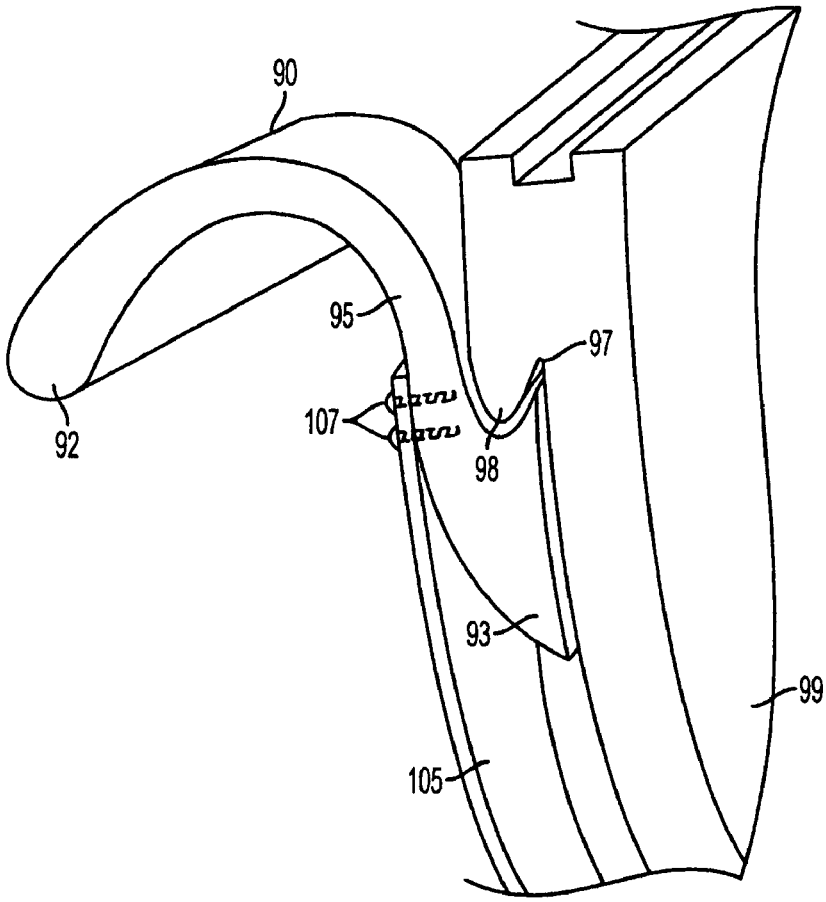
FIG. 12 is a partial sectional view showing details of the manner in which the handles of FIG. 11 attach to the casket base.
Figure 13:
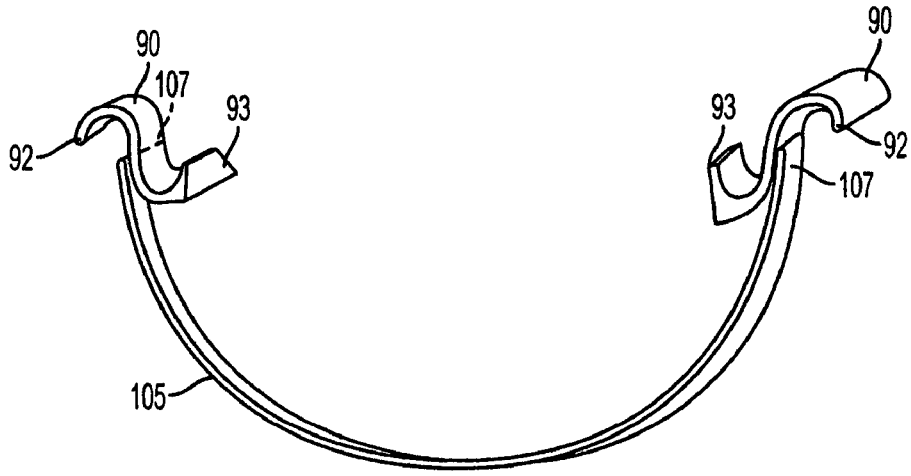
FIG. 13 illustrates the manner in which a pair of handles is arranged for use.

Turning now to FIGS. 12-14 in addition to FIG. 11, FIG. 12 comprises a partial cross-sectional view showing handle 90 in engaged position with a lifting well 97 that is defined by a downwardly projecting lip 98 formed from the wall portion 99 of a casket base 101. Casket base 101 may be of unitary construction as illustrated in FIGS. 1-3, or may be of sectional construction as is depicted in FIG. 9. Wedge attachment portion 93 extends into and engages with lifting well 97 to thus provide a detachable lifting means to move the casket from place to place. It is clear by reference to FIG. 12 that a lifting force applied to the gripping area 92 of handle 90 will produce a large twisting or bending moment to casket side wall 98. It is possible to negate the effect of such a bending moment by thickening or otherwise reinforcing the area of casket wall 98 that is adjacent to the handle attachment locations. It is preferred, however, to form the handles in pairs as is best illustrated in FIG. 13. Each end of a length of flexible strapping 105 is connected to a handle 90 at a location, best shown in FIG. 12, where it does not interfere with the meshing of wedge attachment portion 93 and lifting well 97. Strapping 105 may conveniently be secured to handle 90 using screws or rivets 107 or other suitable mechanical connectors. The length of strapping means 105 is adjusted such that essentially the total load of the casket and its contents is borne by the strapping means when a lifting force is applied to a handle pair in place within the lifting wells on opposite casket sides. A minimum of two handle pairs is ordinarily required for convenient lifting and movement of even the smallest of caskets. Ordinarily, a casket will be provided with three handle pairs as is illustrated in FIG. 14, but four or even five handle pairs can appropriately be provided for use with large and heavy caskets. Depending upon the placement of the handle pairs along the casket and upon the casket profile, the strapping members 105 of the various handle pairs may need to be of slightly different lengths.

Figure 10:
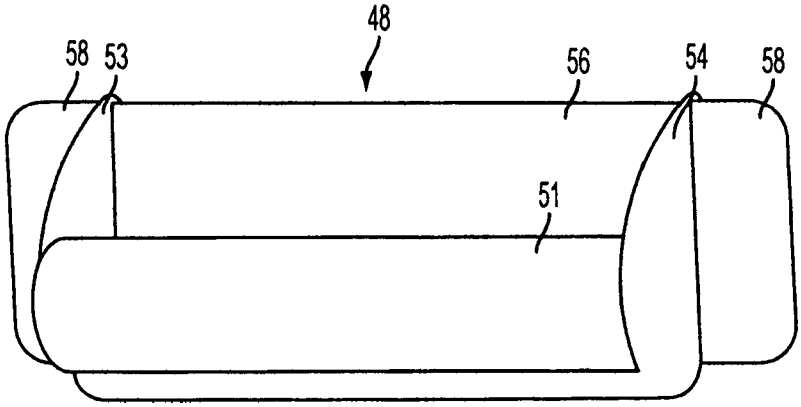
FIG. 10 is a perspective view of a removable handle that is attachable to the casket base.
Figure 15:
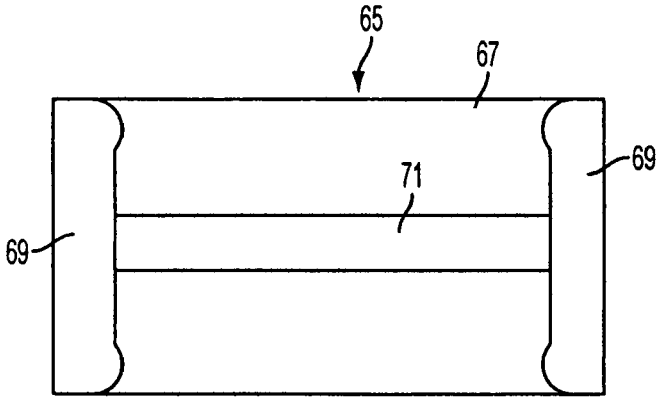
FIG. 15 is a top plan view of a strap tie.
Figure 16:
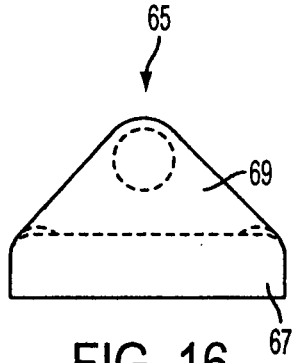
FIG. 16 is an end elevational view of the strap tie of FIG. 15.
Figure 17:
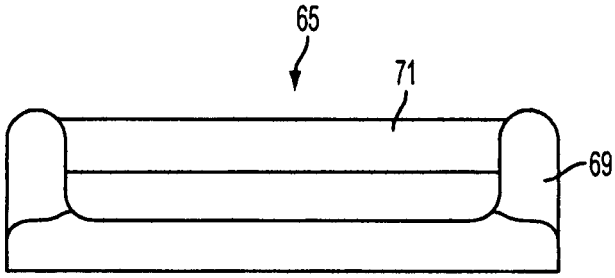
FIG. 17 is a side elevational view of the strap tie of FIG. 15.

A plurality of strap holders 65, illustrated in FIGS. 10, 11, and 12, are fixed to the inside surface of the casket base at locations preferably opposite to the exterior locations of handles 48. A strap holder 65 is shown in top plan view in FIG. 10, in end elevational view in FIG. 11, and in side elevational view in FIG. 12. Referring now to those Figures, strap tie 65 includes a bottom member 67 having a pair of bracket members 69 protruding outwardly therefrom. A tie bar 71 extends between and is fixed to the bracket members 69 to provide an anchoring means for the strapping. The strap holders serve to provide anchor points for the attachment of restraining means such as strapping (not shown) that provide support for the cadaver before and in addition to the foam that is injected into the cavity of the closed casket. Placement of the straps at the locations described ensures that the head, torso, and hips of the remains will be held in correct anatomical relationship when the casket is placed in an upright position even after decomposition or preservation of the remains has taken place. Other types of fastening systems, such as VELCRO®, may also be used for this purpose.

It is preferred that the casket base 12 and casket cover 14 be fabricated from glass fiber reinforced plastic, which is a composite material made up of short strands of fine glass fibers dispersed through a plastic matrix. The plastic matrix may comprise any of the polymers or resins that are commonly used for this purpose including, for example, polyesters, vinylesters, and epoxies as well as any suitable recycled materials. The casket parts may be fabricated, for example, by placing a chopped strand mat of glass fibers in a mold, coating the mat with resin, and then letting it cure. Other manufacturing techniques, including resin transfer, hand lay-up, injection molding, hot or cold forming, or any other technique that is appropriate for use to fabricate components and parts for multi-part structures or composite products may also be employed. Casket cover 14 may also be fabricated entirely from a transparent material to allow viewing.

Any desired finish may then be applied to the casket surfaces. The outer surfaces of the entire unit may be finished with an essentially infinite variety of finishes, textures, paintings, powder-coatings, colors, and other special treatments that render a casket reflectively unique to the person being honored.

In those instances where it is sought to preserve the interred body, the casket end closure panels 15, 16, 17, 18, and 19 are preferably fabricated from reinforced plastic as with the casket base and cover. The various casket parts are permanently joined using a bonding adhesive, including super-glues and other permanent adhesives, which are placed on the edges of the closure panels and on the edges of the casket top and bottom. The casket parts are then immobilized for a time sufficient for the adhesive to set up. Immobilization of the casket parts while the bonding agent is curing may conveniently be obtained by placement of a band of a heat-shrinkable material around the periphery of the casket at the juncture of the casket base and cover to form a collar. Application of heat, using a heat gun for example, causes the collar to shrink and secure the base to the cover. Alternatively, a metal edge binder that is sized to fit the particular casket may be placed around the casket periphery and thereafter tightened using springs and lever means. After the adhesive has cured, the atmosphere within the casket may be replaced with gases or fluids chosen to preserve the contents or a foam may be injected. The ports 35 are then sealed to ensure that the closed casket is fluid-tight and that there is no seepage or contamination. The casket end closure panels may also be utilized for attachment of accessories, such as pressure gages and sampling ports, to test or confirm the condition of the casket interior after the injection of liquids or gases into the casket for preservation purposes and the like.

In other instances it may be desired to allow or even to accelerate the natural processes of decay and integration back to the earth. In those instances, the casket bottom end closure panels 15, 16 and 17, are fabricated from a biodegradable material that disintegrates upon prolonged contact with soil and moisture. If desired, the injected foam may also be modified in composition to include a biodegrading accelerator or enhancer such as an enzyme or the like to allow more rapid assimilation with the soil.

The casket 10 of this invention also may be interred in a horizontal attitude as is the conventional burial practice. However, most advantage will be gained by interring the casket in a vertical orientation. When interred vertically in this fashion, four caskets may fit in the standard grave plot instead of the single casket that is now allocated for that same space. That space saving is becoming increasingly important in the urban areas of the world as land is commanding an increasing premium. It is also a reality that the air borne particulate and gaseous contaminants from cremation are starting to cause serious concern to areas where the air quality is already seriously challenged by emissions from other pollutant sources. Vertical interment also simplifies and substantially reduces the cost for excavating the grave for placement of the casket. In most instances, the grave can be excavated using an auger drill to bore a hole slightly larger in diameter that is the diameter of the casket with a depth equal to the casket length.

It is a reality of the social evolution that has been and is taking place in the funeral services industry that there is a growing demand for individualization or customization of furnishings such as caskets. There is also recognition of the fact that cremation of a body consumes a substantial quantity of fuel as well as releasing significant quantities of particulate matter to the atmosphere. The use of a polymer casket as described herein allows for the providers of funeral services to offer almost unlimited choices of colors, textures, and other customized treatments for the outside surfaces of the casket and for the casket interior as well. Further, the optional use of specific operational characteristics of the plastics used in casket fabrication allows the funeral services provider to respond to the particular requests of the service seeker. It is also of note that in those instances in which a non-degradable casket is chosen that will allow the remains to revert to the earth, there will be no collapse or subsidence of the interment area. The casket itself will retain its structural integrity and no surface disturbance will occur. Where a biodegradable system is used, the resulting subsidence will be notably less difficult to manage than is the case with a traditional, horizontal interment.

Other modifications and variations will be evident to those of ordinary skill in the art without departing from the spirit and scope of the described invention.

I claim:

1. A casket adapted for the vertical burial of human remains, comprising:

a casket base having a top section, a middle section, and a lower section, the middle section being generally hemispherical in cross section;

a casket cover having a top section, a middle section, and a lower section, said cover conforming in size and shape to said casket base so that the casket cover when fitted to the casket base forms a generally cylindrical, open ended enclosure;

a first channel means disposed perpendicularly to the axis of said cylindrical enclosure on the inner surface of both said casket base and casket cover adjacent the lower end thereof;

a first closure panel arranged to fit within said first channel means to close and seal the lower casket end;

a second channel means disposed perpendicularly to the axis of said cylindrical enclosure on the inner surface of both said casket base and casket cover adjacent the top end thereof;

a second closure panel arranged to fit within said second channel means to close and seal the top casket end; and restraining means disposed within the casket interior, said restraining means arranged to hold a cadaver in correct anatomical position when said casket is placed upright for the vertical burial.

2. The casket of claim 1 wherein said casket base is fabricated from a reinforced plastic.

3. The casket of claim 1 wherein said first closure panel is generally planar, said panel having a closable port extending therethrough, said port adapted for the injection of a plastic foam or a gas into the interior of said casket.

4. The casket of claim 1 wherein said first closure panel is constructed of a reinforced plastic.

5. The casket of claim 1 wherein said first closure panel is fabricated from a biodegradable material that disintegrates upon prolonged contact with soil and moisture.

6. The casket of claim 1 wherein said second closure panel is generally planar and is constructed of a reinforced plastic, said second closure panel adapted for attachment of a marker to identify the grave site.

7. The casket of claim 1 including a third channel means disposed perpendicularly to the axis of said cylindrical enclosure on the inner surface of both said casket base and casket cover adjacent the top end thereof and external to said second channel means, and a third closure panel arranged to fit within said third channel means, said third closure panel being generally planar and adapted to carry indication its upper surface to identify the grave site.

8. The casket of claim 1 wherein said restraining means include a plurality of holders fixed to the inside surface of said casket base to provide anchor points for strapping means that are arranged to immobilize a cadaver held in the casket.

9. The casket of claim 1 including a plurality of handle receptacles disposed along the exterior of said casket base, said receptacles arranged in pairs on opposite sides of said casket base, each said receptacle adapted to detachably connect to a handle means.

10. The casket of claim 9 wherein said handle means are arranged in pairs for engagement with a receptacle pair, the two handle means making up a pair being connected one to another through a structural web, the length of said web adjusted so that substantially all of the casket weight is borne by said web when said handle means are connected to a receptacle pair and a lifting force is applied to said handle means.

11. The casket of claim 1 wherein at least the upper part of said casket cover is fabricated from a transparent material.

12. The casket of claim 1 wherein said casket base, casket cover, and first closure panel are fabricated from a biodegradable material that disintegrates upon prolonged contact with soil and moisture.

13. A method for the burial of human remains in a vertical posture, comprising:

providing a casket having a casket base, a casket cover, and upper and lower end closure means, said casket base and casket cover when fitted together forming a generally cylindrical, open ended enclosure;

securing a cadaver in said casket base through restraining means that are arranged to hold a cadaver in correct anatomical position;

attaching each said end closure means to said casket base and to said casket cover to form a sealed enclosure;

providing closable port means in at least one of said end closure means; injecting a material selected from the group consisting of gases, liquids, plastic foams, and mixtures thereof through said port means to fill the casket interior;

sealing said port means; and placing the casket upright within a vertically bored hole in the earth.

14. The method of claim 13 wherein said casket parts are constructed of a reinforced plastic and wherein said injected material is an inert gas.

15. The method of claim 14 wherein said inert gas is selected from the group consisting of nitrogen, argon, and mixtures thereof.

16. The method of claim 13 wherein at least said lower end closure means is fabricated from a biodegradable material that disintegrates upon prolonged contact with soil and moisture.

17. The method of claim 13 wherein said injected material is a plastic foam.

18. The method of claim 17 wherein said casket base, casket cover, and lower end closure means are fabricated from a biodegradable material that disintegrates upon prolonged contact with soil and moisture, and wherein said plastic foam includes a biodegrading accelerator to promote a more rapid assimilation of the casket and its contents with the soil.

* * * * *